US007941900B2

(12) United States Patent
Saeger et al.

(10) Patent No.: US 7,941,900 B2
(45) Date of Patent: May 17, 2011

(54) APPARATUS FOR THE FIBRE-SORTING OR FIBRE-SELECTION OF A FIBRE BUNDLE COMPRISING TEXTILE FIBRES, ESPECIALLY FOR COMBING

(75) Inventors: Nicole Saeger, Aachen (DE); Johannes Boβmann, Mönchengladbach (DE); Thomas Schmitz, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 382 days.

(21) Appl. No.: 12/163,491

(22) Filed: Jun. 27, 2008

(65) Prior Publication Data

US 2009/0000071 A1 Jan. 1, 2009

(30) Foreign Application Priority Data

Jun. 29, 2007 (DE) ..... 10 2007 030 471
Jun. 29, 2007 (DE) ..... 20 2007 010 686 U
Aug. 15, 2007 (DE) ..... 10 2007 038 667
Jan. 25, 2008 (DE) ..... 10 2008 006 239

(51) Int. Cl.
*D01G 19/00* (2006.01)

(52) U.S. Cl. ..... 19/217

(58) Field of Classification Search ..... 19/115 R, 19/128, 215, 216, 217
See application file for complete search history.

(56) References Cited

U.S. PATENT DOCUMENTS 1,408,780 A * 3/1922 Schleifer ..... 19/217
1,425,059 A * 8/1922 Schleifer ..... 19/217
1,694,432 A * 12/1928 Schleifer ..... 19/217
1,708,032 A * 4/1929 Schleifer ..... 19/217
1,715,473 A * 6/1929 Schleifer ..... 19/217
1,799,066 A * 3/1931 Schleifer ..... 19/217
2,962,772 A 12/1960 Draving et al.
2,044,460 A * 10/1963 Bartram et al. ..... 19/99
3,108,333 A * 10/1963 Schleifer ..... 19/235
4,270,245 A 6/1981 Stewart et al.

(Continued)

FOREIGN PATENT DOCUMENTS

DE 367482 C 1/1923

(Continued)

OTHER PUBLICATIONS

German Patent Office Search Report, dated Aug. 8, 2007, issued in related German Application No. 10 2006 384.8, and English language translation of Section C.

(Continued)

*Primary Examiner* — Shaun R Hurley
(74) *Attorney, Agent, or Firm* — Venable LLP; Robert Kinberg; Steven J. Schwarz

(57) ABSTRACT

In an apparatus for the fiber-sorting or fiber-selection of a fiber bundle which is supplied by means of a supply device to a fiber-sorting device, mechanical means are present which generate a combing action in order to loosen and remove non-clamped constituents from the fiber bundle, and a take-off device is present to remove the combed fiber material. To enable an improved combed sliver to be obtained, downstream of the supply device there are arranged at least two rotatably mounted rollers with clamping devices for the fiber bundles, which clamping devices are distributed around the periphery of the rollers, wherein in the region between the rollers, devices are present which provide an optimum feed of the fiber material and/or provide optimum positioning of the fiber material for transfer and take-up from the first roller to the second roller.

21 Claims, 7 Drawing Sheets

U.S. PATENT DOCUMENTS

| | | | | |
|---|---|---|---|---|
| 5,007,623 | A | 4/1991 | Unkuri et al. | |
| 5,343,686 | A | 9/1994 | Buchner et al. | |
| 5,404,619 | A | 4/1995 | Jorg | |
| 5,457,851 | A | 10/1995 | Mondini | |
| 5,502,875 | A | 4/1996 | Stolz et al. | |
| 5,796,220 | A | 8/1998 | Clapp et al. | |
| 6,163,931 | A | 12/2000 | Leifeld | |
| 6,173,478 | B1 | 1/2001 | Patelli et al. | |
| 6,216,318 | B1 | 4/2001 | Leifeld | |
| 6,235,999 | B1 | 5/2001 | Rubenach | |
| 6,295,699 | B1 | 10/2001 | Temburg | |
| 6,499,194 | B1 | 12/2002 | Gresser et al. | |
| 6,611,994 | B2 | 9/2003 | Bischofberger et al. | |
| 7,173,207 | B2 | 2/2007 | Losbrock et al. | |
| 2002/0124354 | A1 | 9/2002 | Pferdmenges et al. | |
| 2003/0005551 | A1* | 1/2003 | Schurenkramer et al. | 19/107 |
| 2003/0029003 | A1* | 2/2003 | Breuer et al. | 19/98 |
| 2003/0070260 | A1 | 4/2003 | Rubenach | |
| 2003/0154572 | A1* | 8/2003 | Pferdmenges et al. | 19/98 |
| 2004/0040121 | A1* | 3/2004 | Schmitz | 19/98 |
| 2004/0128799 | A1* | 7/2004 | Hosel et al. | 19/98 |
| 2005/0076476 | A1 | 4/2005 | Temburg | |
| 2005/0198783 | A1 | 9/2005 | Rubenach | |
| 2005/0278900 | A1 | 12/2005 | Dammig | |
| 2006/0260100 | A1 | 11/2006 | Duda et al. | |
| 2007/0180658 | A1* | 8/2007 | Saeger et al. | 19/98 |
| 2007/0180659 | A1* | 8/2007 | Saeger et al. | 19/98 |
| 2007/0180660 | A1* | 8/2007 | Saeger et al. | 19/98 |
| 2007/0266528 | A1 | 11/2007 | Farber et al. | |
| 2008/0092339 | A1 | 4/2008 | Bossman et al. | |
| 2009/0000064 | A1 | 1/2009 | Saeger et al. | |
| 2009/0000065 | A1 | 1/2009 | Saeger et al. | |
| 2009/0000066 | A1 | 1/2009 | Saeger et al. | |
| 2009/0000067 | A1* | 1/2009 | Leder et al. | 19/115 R |
| 2009/0000068 | A1* | 1/2009 | Saeger et al. | 19/115 R |
| 2009/0000069 | A1 | 1/2009 | Saeger et al. | |
| 2009/0000070 | A1 | 1/2009 | Saeger et al. | |
| 2009/0000072 | A1 | 1/2009 | Saeger et al. | |
| 2009/0000073 | A1 | 1/2009 | Saeger et al. | |
| 2009/0000074 | A1 | 1/2009 | Bossmann | |
| 2009/0000075 | A1* | 1/2009 | Saeger et al. | 19/115 R |
| 2009/0000076 | A1 | 1/2009 | Bossmann et al. | |
| 2009/0000077 | A1 | 1/2009 | Saeger et al. | |
| 2009/0000078 | A1 | 1/2009 | Saeger et al. | |
| 2009/0000079 | A1 | 1/2009 | Bossmann | |

FOREIGN PATENT DOCUMENTS

| | | | |
|---|---|---|---|
| DE | 382169 | C | 9/1923 |
| DE | 399885 | C | 7/1924 |
| DE | 489 430 | C | 1/1930 |
| DE | 30 48 501 | A1 | 7/1982 |
| DE | 103 20 452 | A1 | 11/2004 |
| EP | 1 586 682 | A1 | 10/2005 |
| WO | WO-2006/012758 | A1 | 2/2006 |

OTHER PUBLICATIONS

German Patent Office Search Report dated Jul. 10, 2007, Issued in related German Application No. 10 2006 050 453.4, and partial English-language translation.

U.S. Office Action dated Feb. 26, 2010, issued in related U.S. Appl. No. 12/149,506.

* cited by examiner

APPARATUS FOR THE FIBRE-SORTING OR FIBRE-SELECTION OF A FIBRE BUNDLE COMPRISING TEXTILE FIBRES, ESPECIALLY FOR COMBING

CROSS REFERENCE TO RELATED APPLICATIONS

This application claims priority from German Utility Model Application No. 20 2007 010 686.6 dated 29 Jun. 2007, German Patent Application No. 10 2007 038 667.4 dated 15 Aug. 2007 and German Patent Application No. 10 2008 006 239.1 dated 25 Jan. 2008, the disclosure of each of which is incorporated herein.

BACKGROUND OF THE INVENTION

The invention relates to an apparatus for the fibre-sorting or selection of a fibre bundle comprising textile fibres, especially for combing, in which clamping devices are provided, which clamp the fibre bundle at a distance from its free end and mechanical devices are present which generate a combing action from the clamping site to the free end of the fibre bundle in order to loosen and remove non-clamped constituents, such as, for example, short fibres, neps, dust and the like from the free end, wherein for removal of the combed fibre material a take-off device is present.

In practice, combing machines are used to free cotton fibres or woollen fibres of natural impurities contained therein and to parallelise the fibres of the fibre sliver. For that purpose, a previously prepared fibre bundle is clamped between the jaws of the nipper arrangement so that a certain sub-length of the fibres, known as the "fibre tuft", projects at the front of the jaws. By means of the combing segments of the rotating combing roller, which segments are filled with needle clothing or toothed clothing, this fibre tuft is combed and thus cleaned. The take-off device usually consists of two counter-rotating rollers, which grip the combed fibre tuft and carry it onwards. The known cotton-combing process is a discontinuous process. During a nipping operation, all assemblies and their drive means and gears are accelerated, decelerated and in some cases reversed again. High nip rates result in high acceleration. Particularly as a result of the kinematics of the nippers, the gear for the nipper movement and the gear for the pilgrim-step movement of the detaching rollers, high acceleration forces come into effect. The forces and stresses that arise increase as the nip rates increase. The known flat combing machine has reached a performance limit with its nip rates, which prevents productivity from being increased. Furthermore, the discontinuous mode of operation causes vibration in the entire machine, which generates dynamic alternating stresses.

EP 1 586 682 A discloses a combing machine in which, for example, eight combing heads operate simultaneously one next to the other. The drive of those combing heads is effected by means of a lateral drive means arranged next to the combing heads having a gear unit which is in driving connection by way of longitudinal shafts with the individual elements of the combing heads. The fibre slivers formed at the individual combing heads are transferred, one next to the other on a conveyor table, to a subsequent drafting system in which they are drafted and then combined to form a common combing machine sliver. The fibre sliver produced in the drafting system is then deposited in a can by means of a funnel wheel (coiler plate). The plurality of combing heads of the combing machine each have a feed device, a pivotally mounted, fixed-position nipper assembly, a rotatably mounted circular comb having a comb segment for combing out the fibre bundle supplied by the nipper assembly, a top comb and a fixed-position detaching device for detaching the combed-out fibre bundle from the nipper assembly. The lap ribbon supplied to the nipper assembly is here fed via a feed cylinder to a detaching roller pair. The fibre bundle protruding from the opened nipper passes onto the rearward end of a combed sliver web or fibre web, whereby it enters the clamping nip of the detaching rollers owing to the forward movement of the detaching rollers. The fibres that are not retained by the retaining force of the lap ribbon, or by the nipper, are detached from the composite of the lap ribbon. During this detaching operation, the fibre bundle is additionally pulled by the needles of a top comb. The top comb combs out the rear part of the detached fibre bundle and also holds back neps, impurities and the like. Owing to the differences in speed between the lap ribbon and the detaching speed of the detaching rollers, the detached fibre bundle is drawn out to a specific length. Following the detaching roller pair is a guide roller pair. During this detaching operation, the leading end of the detached or pulled off fibre bundle is overlapped or doubled with the trailing end of the fibre web. As soon as the detaching operation and the piecing operation have ended, the nippers return to a rear position in which they are closed and present the fibre bundle protruding from the nipper to a comb segment of a circular comb for combing out. Before the nipper assembly now returns to its front position again, the detaching rollers and the guide rollers perform a reversing movement, whereby the trailing end of the fibre web is moved backwards by a specific amount. This is required to achieve a necessary overlap for the piecing operation. In this way, a mechanical combing of the fibre material is effected. Disadvantages of that combing machine are especially the large amount of equipment required and the low hourly production rate. There are eight individual combing heads which have in total eight feed devices, eight fixed-position nipper assemblies, eight circular combs with comb segments, eight top combs and eight detaching devices. A particular problem is the discontinuous mode of operation of the combing heads. Additional disadvantages result from large mass accelerations and reversing movements, with the result that high operating speeds are not possible. Finally, the considerable amount of machine vibration results in irregularities in the deposition of the combed sliver. Moreover, the ecartement, that is to say the distance between the nipper lip of the lower nipper plate and the clamping point of the detaching cylinder, is structurally and spatially limited. The rotational speed of the detaching rollers and the guide rollers, which convey the fibre bundles away, is matched to the upstream slow combing process and is limited by this. A further drawback is that each fibre bundle is clamped and conveyed by the detaching roller pair and subsequently by the guide roller pair. The clamping point changes constantly owing to the rotation of the detaching rollers, i.e. there is a constant relative movement between the rollers effecting clamping and the fibre bundle. All fibre bundles have to pass through the one fixed-position detaching roller pair and the one fixed-position guide roller pair in succession, which represents a further considerable limitation of the production speed.

SUMMARY OF THE INVENTION

It is an aim of the invention is to provide an apparatus of the kind described at the beginning which avoids or mitigates the mentioned disadvantages and which in a simple way, in particular, enables the amount produced per hour (productivity) to be substantially increased and an improved combed sliver to be obtained.

The invention provides an apparatus for the fibre-sorting or fibre-selection of a fibre bundle comprising textile fibres having:

a fibre sorting device in which clamping devices are provided which each clamp a bundle of the textile fibres at a distance from its free end;

a supply device for supplying the fibre bundle to the fibre-sorting device; and at least one mechanical device for generating a combing action from the clamping site to the free end of the fibre bundle in order to loosen and remove non-clamped constituents;

wherein the fibre-sorting device comprises at least first and second rotatably mounted rollers that, in use, rotate rapidly without interruption, the clamping devices for the fibre bundles being distributed spaced apart in the region of the periphery of at least one said roller, and the apparatus further comprises at least one guide device for influencing the transfer of fibre material between said first roller and said second roller.

By implementing the functions of clamping and moving the fibre bundles to be combed-out on high-speed rotating rollers, preferably a turning rotor and a combing rotor, high operating speeds (nip rates) are achievable—unlike the known apparatus—without large mass accelerations and reversing movements. In particular, the mode of operation is continuous. When high-speed rollers are used, a very substantial increase in hourly production rate (productivity) is achievable which had previously not been considered possible in technical circles. A further advantage is that the rotary rotational movement of the rollers with the plurality of clamping devices leads to an unusually rapid supply of a plurality of fibre bundles per unit of time to the first roller and to the second roller. In particular the high rotational speed of the rollers allows production to be substantially increased.

To form the fibre bundle, the fibre material pushed forward by the feed roller is clamped at one end by a clamping device and detached by the rotary movement of the turning rotor. The clamped end contains short fibres, the free region comprises the long fibres. The long fibres are pulled by separation force out of the fibre material clamped in the feed nip, short fibres remaining behind through the retaining force in the feed nip. Subsequently, as the fibre bundle is transferred from the turning rotor onto the combing rotor the ends of the fibre bundle are reversed: the clamping device on the combing rotor grips and clamps the end with the long fibres, so that the region with the short fibres projects from the clamping device and lies exposed and can thereby be combed out.

The fibre bundles are—unlike the known apparatus—held by a plurality of clamping devices and transported under rotation. The clamping point at the particular clamping devices therefore remains substantially constant on each roller until the fibre bundles are transferred to the subsequent roller or take-off roller. A relative movement between clamping device and fibre bundle does not begin until after the fibre bundle has been gripped by the first and second roller respectively and in addition clamping has been terminated. Because a plurality of clamping devices is available for the fibre bundles, in an especially advantageous manner fibre bundles can be supplied to the first and second roller respectively one after the other and in quick succession, without undesirable time delays resulting from just a single supply device. A particular advantage is that the supplied fibre bundles on the first roller (turning rotor) are continuously transported. The speed of the fibre bundle and of the co-operating clamping elements is the same. The clamping elements close and open during the movement in the direction of the transported fibre material. The second roller (combing rotor) is arranged downstream of the first roller (turning rotor). With the apparatus according to the invention, a substantially increased productivity is achievable. A further particular advantage is that suction and/or blowing devices (hoods) enable an optimised alignment of the fibre bundle and improved transfer of the fibre bundle from the turning rotor to the combing rotor to be achieved.

In certain preferred embodiments, pneumatic guide means are present. Advantageously, the guide means include at least one suction device. Advantageously, the suction device is an extractor hood. Advantageously, the extractor hood is arranged in the nip region between turning rotor and combing rotor. Advantageously, the guide means include at least one blowing device. Advantageously, the blowing device is a blowing hood. Advantageously, the blowing hood is arranged in the nip region between turning rotor and combing rotor. Advantageously, at least one hood is mounted in the upper nip region between turning rotor and combing rotor. Advantageously, at least one hood is mounted in the lower nip region between turning rotor and combing rotor. Advantageously, each extractor hood is connected to a source of reduced pressure. Advantageously, each blowing hood is connected to a source of increased pressure. Advantageously, the reduced pressure and/or increased pressure at each hood is adjustable. In some embodiments, the suction or blowing at each hood is effected continuously. In other embodiments, the suction or blowing at each hood is effected in timed mode. Advantageously, the position of the at least one hood in relation to the nip region is adjustable. Advantageously, the distance of the at least one hood from the nip region is adjustable, for example, horizontally and/or vertically. Advantageously, the suction angle or blowing angle is adjustable. Advantageously, the position of the at least one hood in relation to the turning rotor and/or combing rotor is adjustable. Advantageously, the suction angle or blowing angle of the at least one hood in relation to the turning rotor and/or the combing rotor is adjustable. Advantageously, the at least one hood comprises a transverse duct optimised in respect of flow. Advantageously, the geometry of the hood is adapted to the hood position. Advantageously, the geometry of the hood is adapted to the hood function. Advantageously, the hoods have opening slots of different sizes. Advantageously, the hoods have cross-sections of different sizes. Advantageously, the hood is provided for bundle pre-alignment. Advantageously, the number of hoods in the upper and/or lower nip region is variable. Advantageously, the positioning of the hoods relative to one another in the upper and/or lower nip region is variable. Advantageously, for tuft pre-alignment additionally at least one nozzle is present. Advantageously, additional nozzles with different nozzle geometries are present. The nozzle or nozzles may be used for jetting air. Advantageously, the pressure of the jetting is adjustable. Advantageously, the angle of the jetting is adjustable. Advantageously, the nozzles are positioned in the upper nip region. Advantageously, the nozzles are positioned in the lower nip region. In some embodiments, the at least one hood and/or the at least one nozzle is associated with the outer periphery of the turning rotor and/or combing rotor. Advantageously, the at least two rotatably mounted rollers that rotate rapidly without interruption comprise at least one turning rotor and at least one combing rotor.

Advantageously, the turning rotor and the combing rotor have different directions of rotation. For suction of the supplied fibre bundles, at least one suction device is advantageously associated with the clamping devices in the region of the transfer of the fibre bundle from the supply device to the first roller and/or in the region of the transfer of the fibre material from the first roller to the second roller.

The invention also provides an apparatus for the fibre-sorting or fibre-selection of a fibre bundle comprising textile fibres, especially for combing, which is supplied by means of supply means to a fibre-sorting device, especially a combing device, in which clamping devices are provided which clamp the fibre bundle at a distance from its free end, and mechanical means are present which generate a combing action from the clamping site to the free end of the fibre bundle in order to loosen and remove non-clamped constituents, such as, for example, short fibres, neps, dust and the like from the free end, wherein for removal of the combed fibre material a take-off means is present, characterised in that downstream of the supply means there are arranged at least two rotatably mounted rollers rotating rapidly without interruption, which are provided with clamping devices for the fibre bundle, which clamping devices are distributed spaced apart in the region of the periphery of the rollers, wherein, in the region between the rollers, means for optimum feed and/or positioning for the transfer and/or take-up of the fibre material from the first roller to the second roller are present.

BRIEF DESCRIPTION OF THE DRAWINGS

Certain embodiments of the invention are described in greater detail below with reference to the accompanying drawings, in which.

DETAILED DESCRIPTION OF CERTAIN PREFERRED EMBODIMENTS

Figure 1:
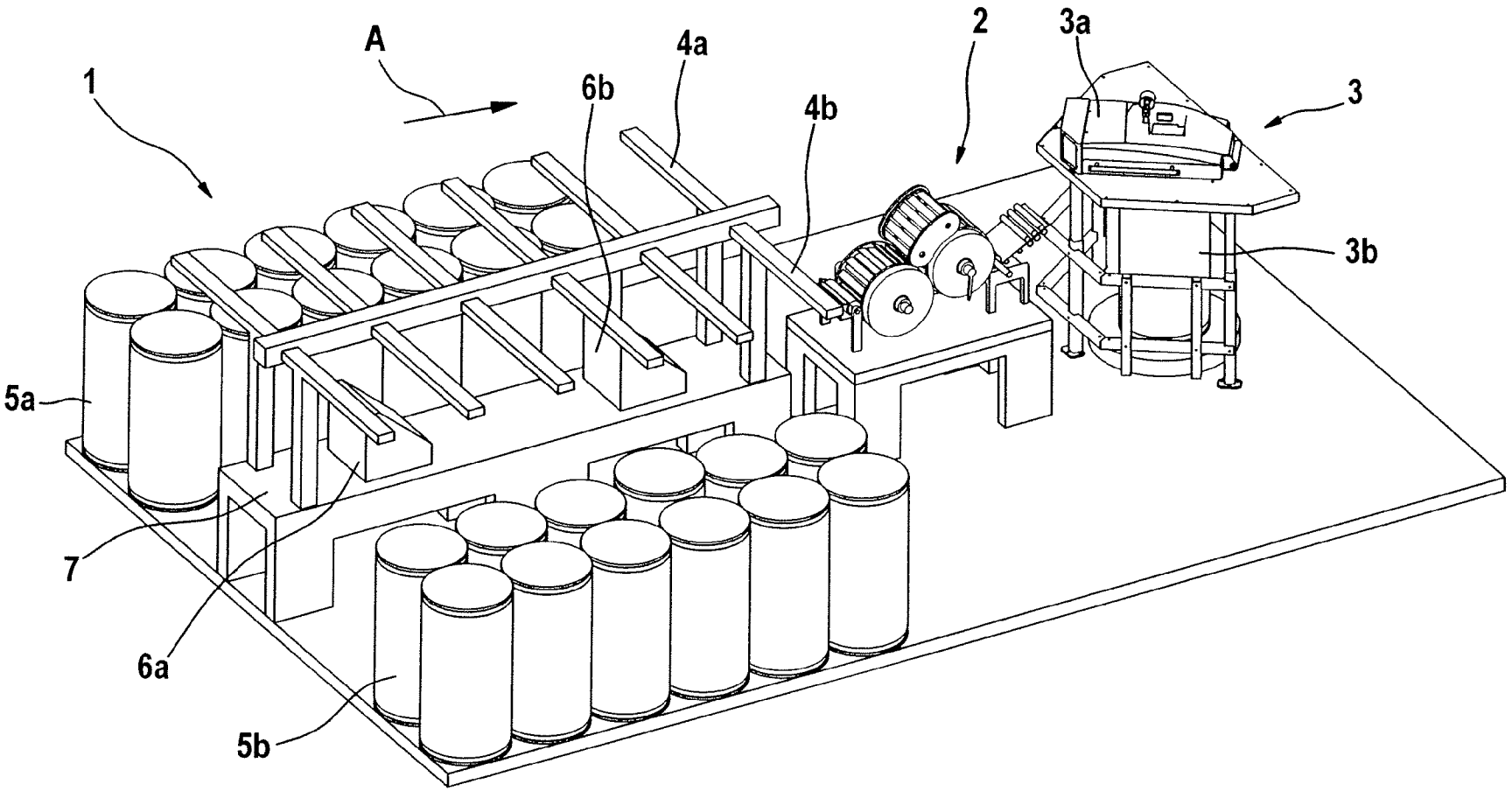
FIG. 1 is a diagrammatic perspective view of a device for combing fibre material, comprising a combing preparation device, a rotor combing machine and a sliver-deposition device.

With reference to FIG. 1, a combing preparation machine 1 has a sliver-fed and lap-delivering spinning room machine and two feed tables 4*a*, 4*b* (creels) arranged parallel to one another, there being arranged below each of the feed tables 4*a*, 4*b* two rows of cans 5*a*, 5*b* containing fibre slivers (not shown). The fibre slivers withdrawn from the cans 5*a*, 5*b* pass, after a change of direction, into two drafting systems 6*a*, 6*b* of the combing preparation machine 1, which are arranged one after the other. From the drafting system 6*a*, the fibre sliver web that has been formed is guided over the web table 7 and, at the outlet of the drafting system 6*b*, laid one over the other and brought together with the fibre sliver web produced therein. By means of the drafting systems 6*a* and 6*b*, in each case a plurality of fibre slivers are combined to form a lap and drafted together. A plurality of drafted laps (two laps in the example shown) are doubled by being placed one on top of the other. The lap so formed is introduced directly into the supply device (feed element) of the downstream rotor combing machine 2. The flow of fibre material is not interrupted. The combed fibre web is delivered at the outlet of the rotor combing machine 2, passes through a funnel 64, forming a comber sliver, and is deposited in a downstream sliver-deposition device 3. Reference numeral A denotes the operating direction.

An autoleveller drafting system 50 (see FIG. 2) can be arranged between the rotor combing machine 2 and the sliver-deposition device 3. The combed sliver is thereby drafted.

In accordance with a further construction, more than one rotor combing machine 2 is provided. If, for example, two rotor combing machines 2*a* and 2*b* are present, then the two delivered combed slivers 17 can pass together through the downstream autoleveller drafting system 50 and be deposited as one drafted combed sliver in the sliver-deposition device 3.

The sliver-deposition device 3 comprises a rotating coiler head 3*a*, by which the combed sliver can be deposited in a can 3*b* or (not shown) in the form of a can-less fibre sliver package.

Figure 2:
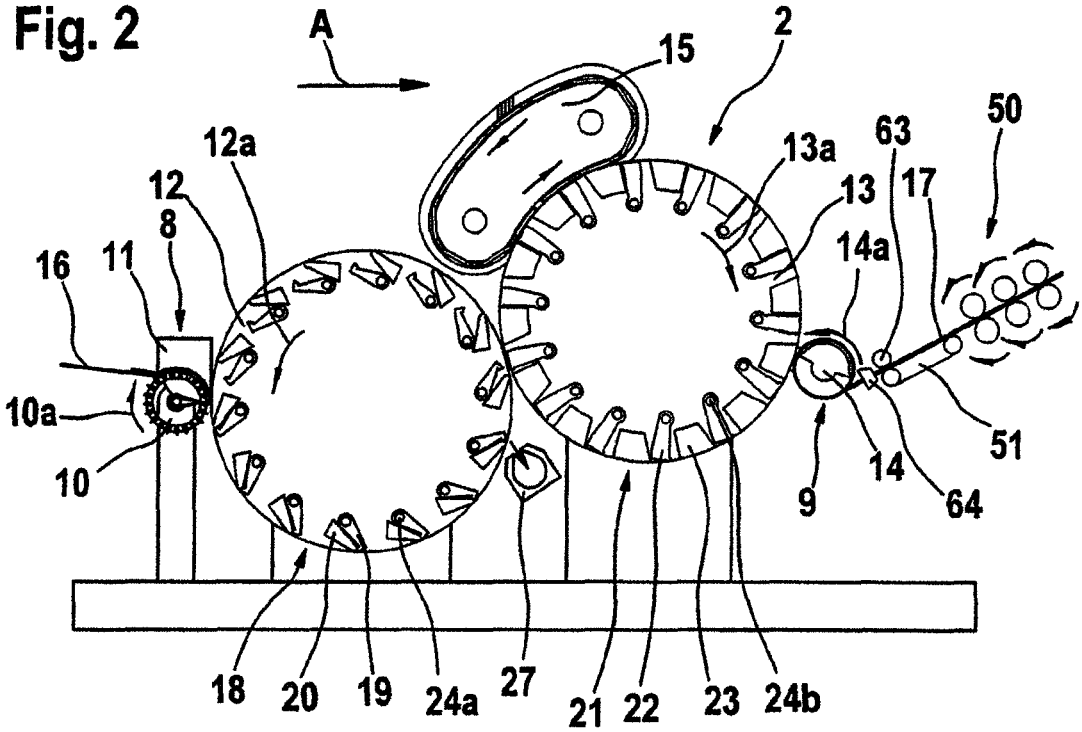
FIG. 2 is a diagrammatic side view of a rotor combing machine according to the invention having two rollers and are combing element.

FIG. 2 shows a rotor combing machine 2 having a supply device 8 comprising a feed roller 10 and a feed tray 11, having a first roller 12 (turning rotor), second roller 13 (combing rotor), a take-off device 9 comprising a take-off roller 14 and a revolving card top combing assembly 15. The directions of rotation of the rollers 10, 12, 13 and 14 are shown by curved arrows 10*a*, 12*a*, 13*a* and 14*a*, respectively. The incoming fibre lap is indicated by reference numeral 16 and the delivered fibre web is indicated by reference numeral 17. The rollers 10, 12, 13 and 14 are arranged one after the other. Arrow A denotes the operating direction.

The first roller 12 is provided in the region of its outer periphery with a plurality of first clamping devices 18 which extend across the width of the roller 12 (see FIG. 3) and each consist of an upper nipper 19 (gripping element) and a lower nipper 20 (counter-element). In its one end region facing the centre point or the pivot axis of the roller 12, each upper nipper 19 is rotatably mounted on a pivot bearing 24*a*, which is attached to the roller 12. The lower nipper 20 is mounted on the roller 12 so as to be either fixed or movable. The free end of the upper nipper 19 faces the periphery of the roller 12. The upper nipper 19 and the lower nipper 20 cooperate so that they are able to grip a fibre bundle 16, $\mathbf{30}_2$ (clamping) and release it.

The second roller 13 is provided in the region of its outer periphery with a plurality of two-part clamping devices 21, which extend across the width of the roller 13 (see FIG. 3) and each consist of an upper nipper 22 (gripping element) and a lower nipper 23 (counter-element). In its one end region facing the centre point or the pivot axis of the roller 13, each upper nipper 22 is rotatably mounted on a pivot bearing 24*b*, which is attached to the roller 13. The lower nipper 23 is mounted on the roller 13 so as to be either fixed or movable. The free end of the upper nipper 22 faces the periphery of the roller 13. The upper nipper 22 and the lower nipper 23 cooperate so that they are able to grip a fibre bundle $\mathbf{30}_2$ (clamping) and release it. In the case of roller 12, around the roller periphery between the feed roller 10 and the second roller 13 the clamping devices 18 are closed (they clamp fibre bundles (not shown) at one end) and between the second roller 13 and the feed roller 10 the clamping devices 18 are open. In roller 13, around the roller periphery between the first roller 12 and the doffer 14 the clamping devices 21 are closed (they clamp fibre bundles (not shown) at one end) and between the doffer 14 and the first roller 12 the clamping devices 21 are open. Reference numeral 50 denotes a drafting system, for example an autoleveller drafting system. The drafting system 50 is advantageously arranged above the coiler head 3*a*. Reference numeral 51 denotes a driven ascending conveyor, for example a conveyor belt. It is also possible to use an upwardly inclined metal sheet or the like for conveying purposes.

Figure 3:
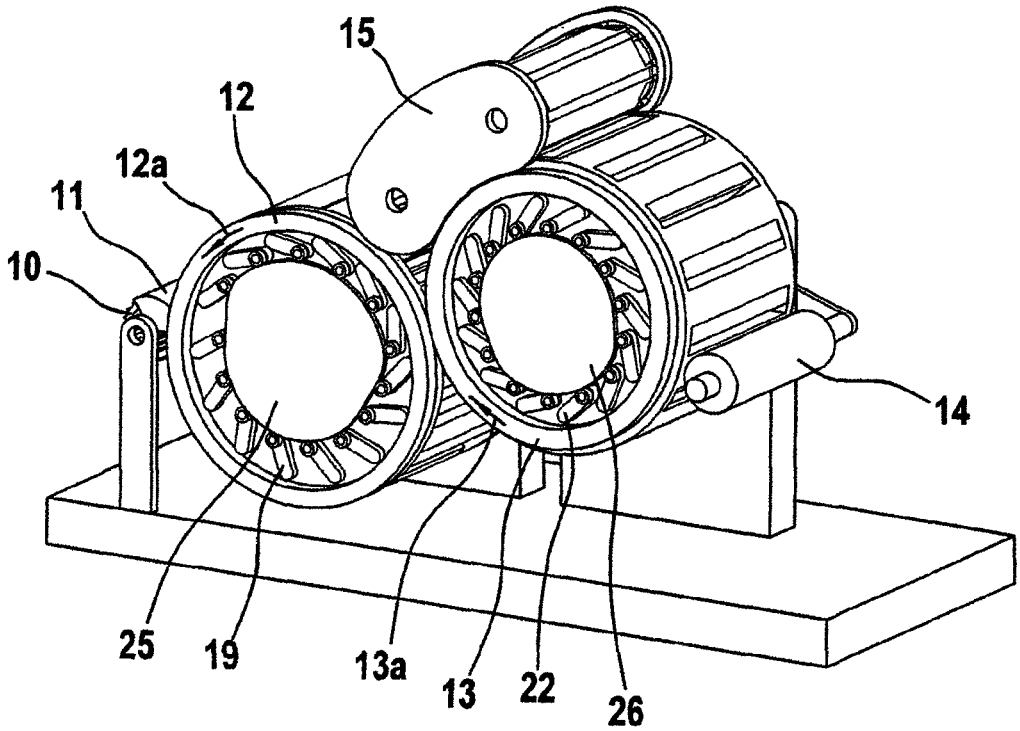
FIG. 3 is a perspective view of the rotor combing machine according to FIG. 2 having two cam discs.

In the embodiment of FIG. 3, two fixed cam discs 25 and 26 are provided, about which the roller 12 having the first clamping devices 18 and the roller 13 having the second clamping device 21 are rotated in the direction of arrows 12*a* and 13*a*, respectively. The loaded upper nippers 19 and 22 are arranged in the intermediate space between the outer periphery of the cam discs 25, 26 and the inner cylindrical surfaces of the rollers 12, 13. By rotation of the rollers 12 and 13 about the cam discs 25 and 26 respectively, the upper nippers 19 and 22 are rotated about pivot axes 24*a* and 24*b*, respectively. In that way, the opening and closing of the first clamping devices 18 and the second clamping devices 21 is implemented.

Figure 4:
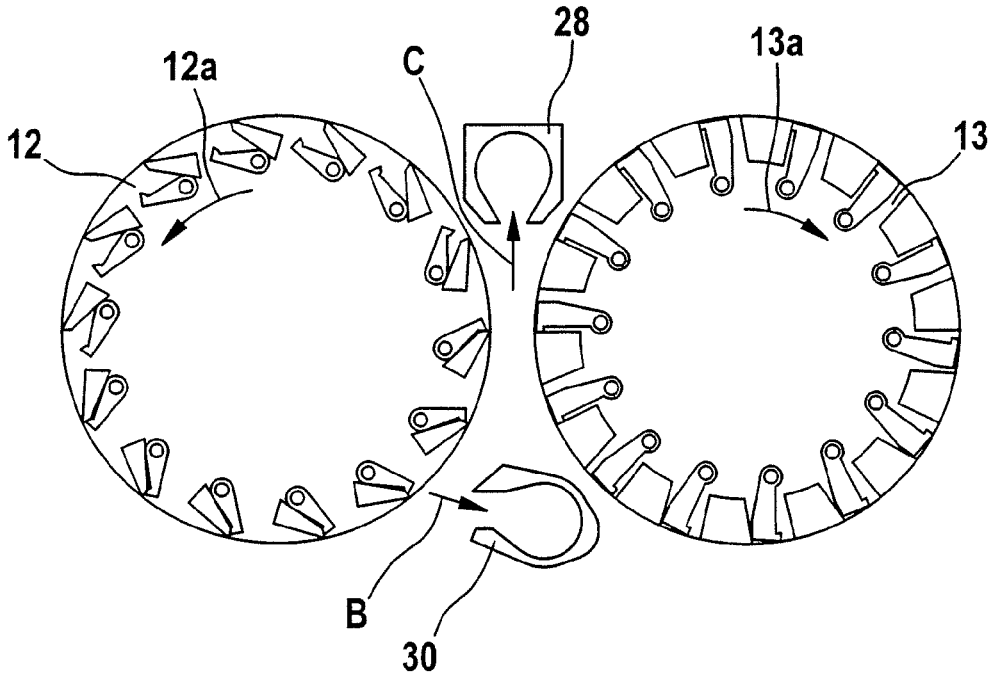
FIG. 4 shows a hood in the upper nip region and a hood in the lower nip region between turning rotor and combing rotor.

In the embodiment of FIG. 4, a hood 28 is provided in the upper nip region and a hood 30 is provided in the lower nip region between turning rotor 12 and combing rotor 13. The hoods 28 and 30 are extractor hoods, into which suction air currents B and C respectively enter.

Figure 5:
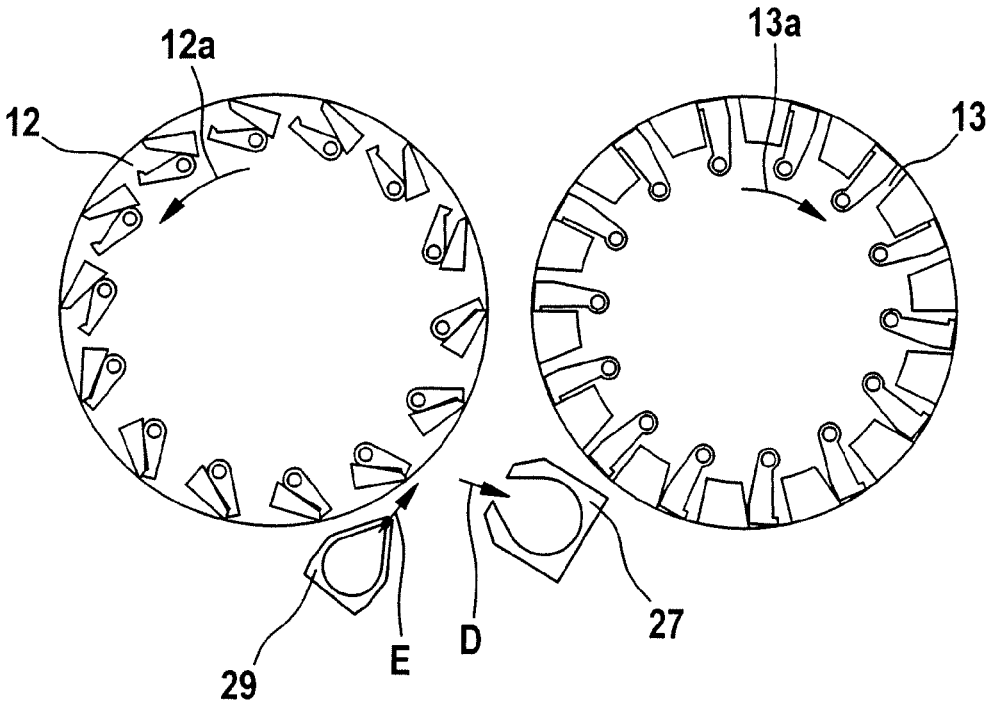
FIG. 5 shows a hood in the lower nip region between turning rotor and combing rotor with an additional blowing hood inserted for pre-alignment of the bundle.

In the embodiment of FIG. 5, two hoods 27 and 29 are present in the lower nip region between turning rotor 12 and combing rotor 13. The hood 27 is an extractor hood, into which a suction air current D enters. The hood 29 is a blowing hood, from which a blown air current E emerges. The hoods 27, 28 and 30 are connected to a source of suction (not shown) and the hood 29 is connected to a source of blown air (not shown).

Figure 6:
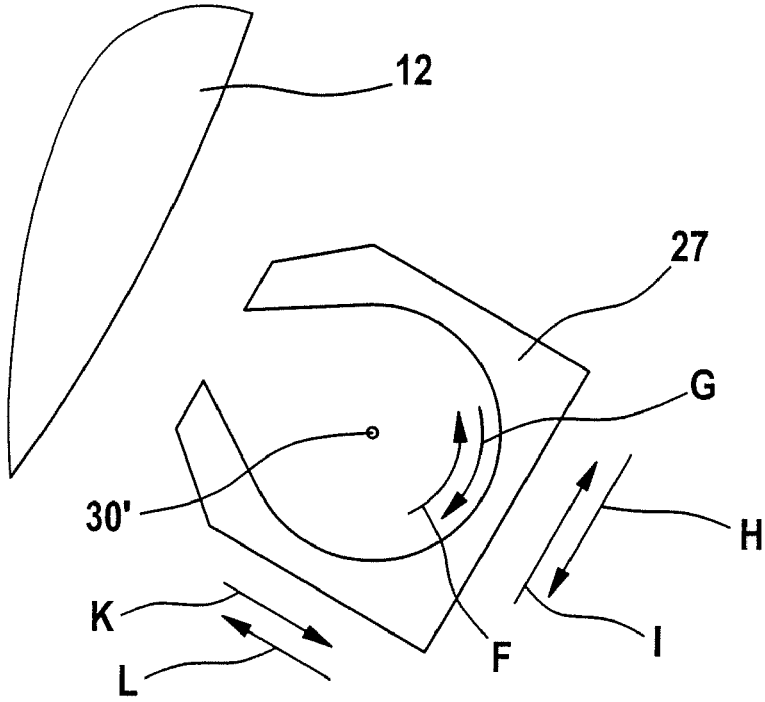
FIG. 6 shows the relative rotary and displacement directions of an extractor hood in relation to a turning rotor.

In the embodiment of FIG. 6, the extractor hood 27 is rotatable about the pivot point 30' in the direction of the arrows F, G and displaceable in the direction of arrows H, I and K, L in relation to the turning rotor 12.

Figure 7:
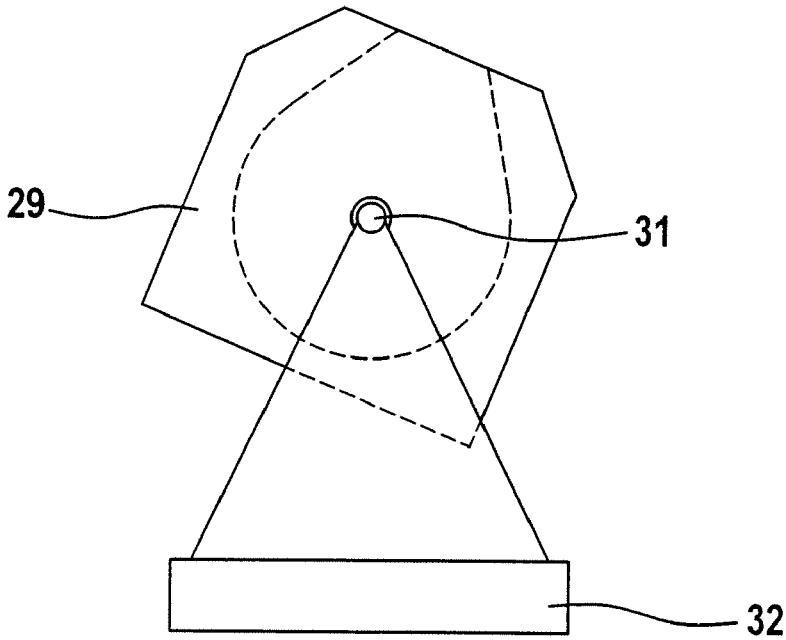
FIG. 7 shows an extractor hood with rotary bearing.

In the embodiment of FIG. 7, a pivot bearing 31 is shown, around which the blowing hood 29 is rotatable (cf. FIG. 6). The reference numeral 32 denotes a support for the pivot bearing 31.

Analogous to the illustration in FIG. 6 for the extractor hood 27, the extractor hoods 28 and 30 and the blowing hood 29 are of rotatable and slidable construction in relation to the turning rotor.

Transfer from the first roller to, and take-up by, the second roller with suction device.

Figure 8A:
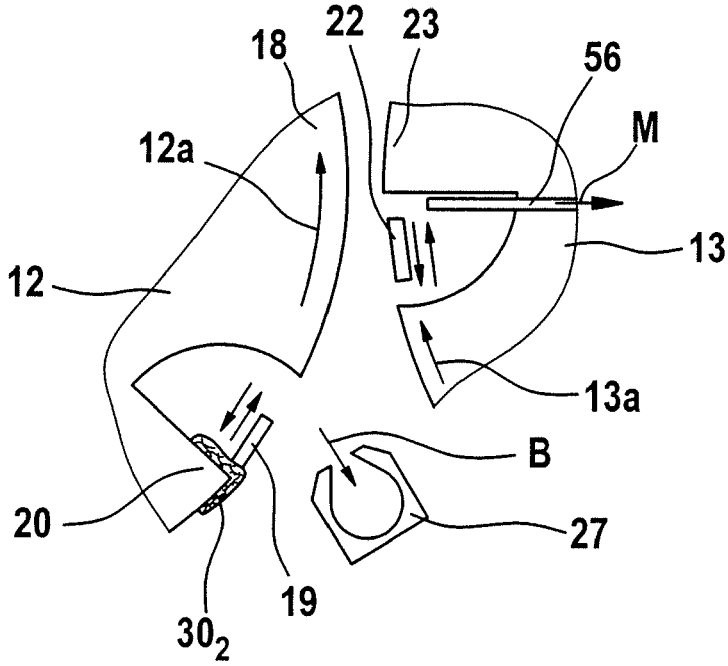
FIG. 8*a* to 8*c* show in diagrammatic form the operating sequence during suction and pre-alignment of the fibre bundle transported in rotation on the first roller.
Figure 8B:
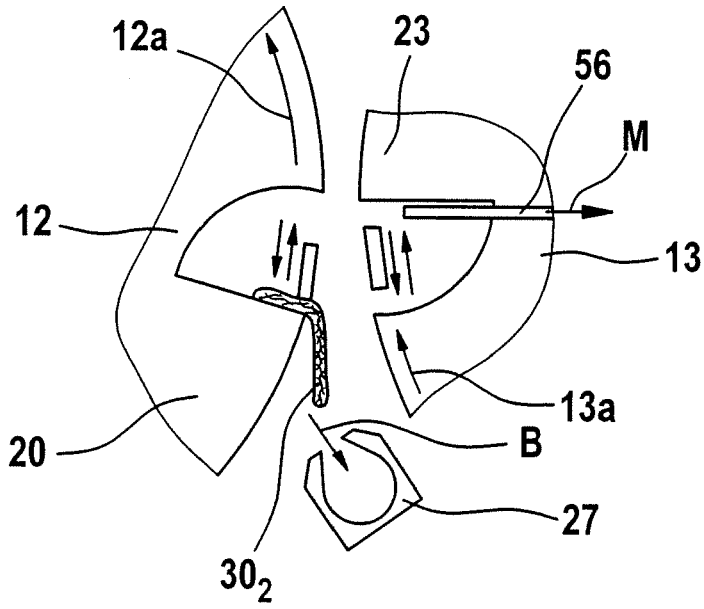
Figure 8C:
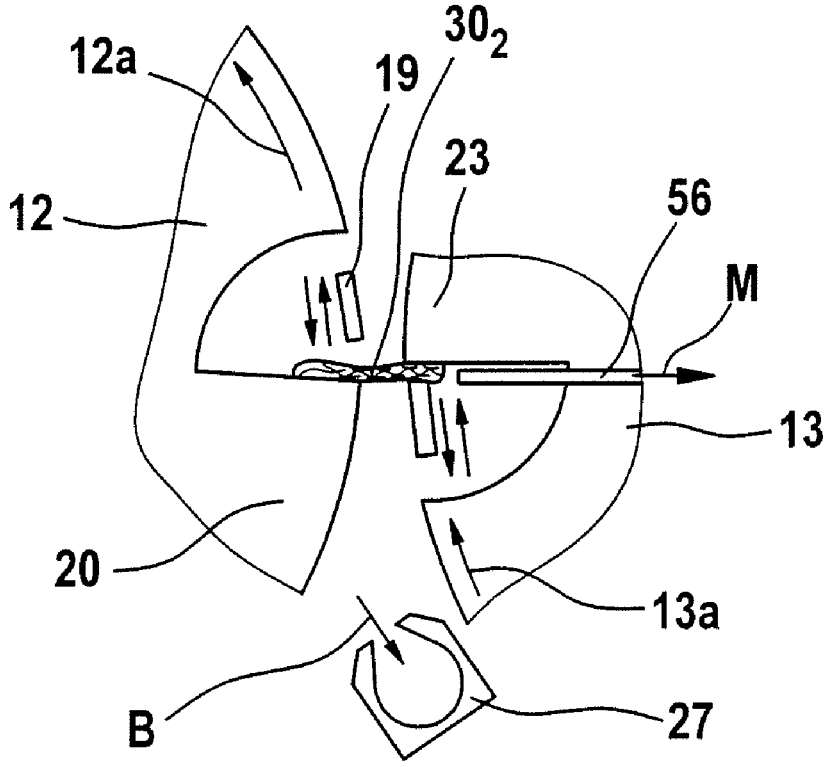

FIGS. 8*a*, 8*b* and 8*c* illustrate diagrammatically the operating sequence during transfer of the supplied fibre material $\mathbf{30}_2$ from the first roller 12 to the roller 13 (combing rotor) acted upon by suction, and the take-up of the supplied fibre material $\mathbf{30}_2$ from the first roller 12 by the second roller 13 acted upon by suction, the Figures showing one after the other in chronological order:

according to FIG. 8*a*, transport of the fibre bundle $\mathbf{30}_2$ by the roller 12 is effected in direction 12*a* into the suction region of the extractor hood 27, with clamping of the clamped end of the fibre bundle $\mathbf{30}_2$ by the closed clamping device 18 comprising upper nipper 19 and the lower nipper 20. FIG. 8*b* shows suction of the free end of the fibre bundle $\mathbf{30}_2$ by the air current B of the extractor hood 27. The fibre bundle $\mathbf{30}_2$ is thereby deflected from the surface of the turning rotor 12 and hereby pre-aligned and positioned for transfer to and take-up by the combing rotor 13. FIG. 8*c* shows suction of the free end of the fibre bundle $\mathbf{30}_2$ by the air current M of the suction channel 56 between the upper nipper 22 and the lower nipper 23. Through the suction, the fibre bundle $\mathbf{30}_2$ bent at an angle is stretched out and aligned. In this operation, the one end region of the fibre bundle $\mathbf{30}_2$ continues to be clamped between upper nipper 19 and lower nipper 20 of the closed clamping device 18.

Using the rotor combing machine 2 according to the invention, more than 2000 nips/min, for example from 3000 to 5000 nips/min, are achieved.

Figure 9:
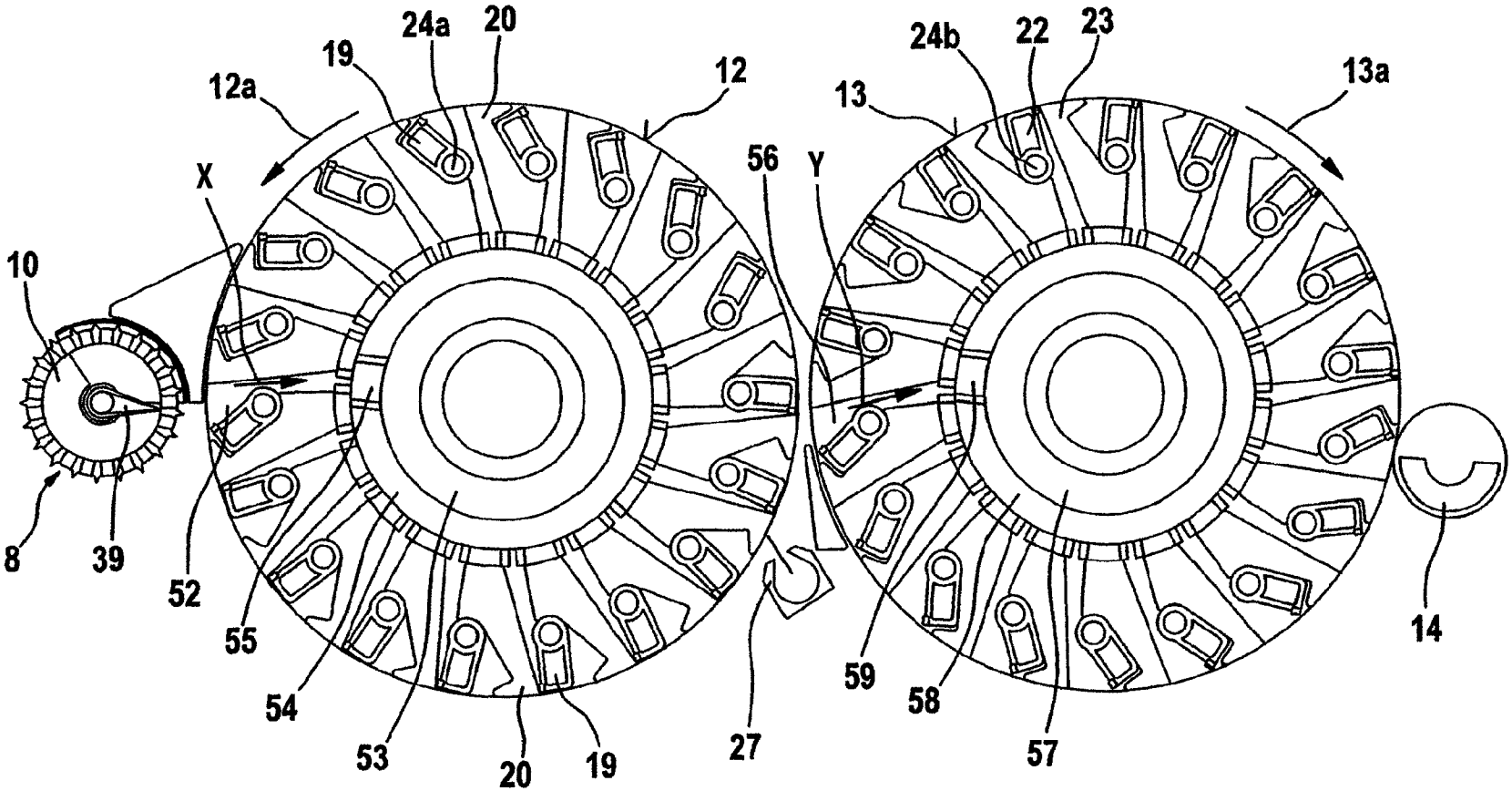
FIG. 9 shows a rotor combing machine according to the invention, in which suction devices are associated with the clamping devices.

In the embodiment of FIG. 9, the rotatably mounted rollers 12 and 13 with clamping devices 19, 20 and 22, 23 are equipped additionally with suction channels 52 and 56, respectively (suction openings), which, in the region of the delivery between the supply device 8 and the roller 12 and in the region of the delivery between the rollers 12 and 13, influence the alignment and movement of the fibres being transported. In that way, the time for the taking up of the fibre material from the supply device 8 onto the first roller 12 and the delivery to the second roller 13 is significantly reduced, so that the nip rate can be increased. The suction openings 52, 56 are arranged within the rollers 12 and 13, respectively, and rotate with the rollers. At least one suction opening is associated with each clamping device 19, 20 and 22, 23 (nipper device). The suction openings 52, 56 are each arranged between a gripping element (upper nipper) and counter-element (lower nipper). In the interior of the rotors 12, 13 there is a reduced pressure region 53 to 55 and 57 to 59, respectively, created by the suction flow at the suction openings 52, 56. The reduced pressure can be generated by connecting to a flow-generating machine. The suction flow X, Y at the individual suction openings 52, 56 can be so switched between reduced pressure region and suction opening that it is applied only at particular selected angular positions on the roller circumference. For the purpose of the switching, valves or a valve pipe 54, 58 with openings 55 and 59, respectively, in the corresponding angular positions can be used. The release of the suction flow may also be brought about by the movement of the gripping element (upper nipper). Furthermore, it is possible to arrange a region of reduced pressure only at the corresponding angular positions.

Additionally, a flow of blown air, herein known as "jetting", can be provided in the region of the supply device 8 and/or in the region of transfer between the rollers. The source of the flow of blown air (blowing nozzle 39) is arranged inside the feed roller 10 acts through the air-permeable surface of the supply device or air passage openings, towards the outside in the direction of the first roller. Also, in the region of the supply device 8, the element for producing the blown air flow can be fixedly arranged, directly under or over the supply device 8. In the region of the transfer between the rollers 12, 13 the blown air current sources can be arranged at the perimeter of the first roller 12, directly under or over each nipper device. For the blown air generation compressed air nozzles or air blades may be used.

The combed out fibre portion passes from the second roller 13 onto the piecing roller 14.

Using the rotor combing machine according to the invention there is achieved a mechanical combing of the fibre material to be combed out, that is, mechanical means are used for the combing. There is no pneumatic combing of the fibre material to be combed, that is, no air currents, e.g. suction and/or blown air currents, are used for combing.

In the rotor combing machine according to the invention there are present rollers that rotate rapidly without interruption continuously and that have clamping devices. Rollers that rotate with interruptions, stepwise or alternating between a stationary and rotating state are not used.

Although the foregoing invention has been described in detail by way of illustration and example for purposes of understanding, it will be obvious that changes and modifications may be practised within the scope of the appended claims.

What is claimed is:

1. An apparatus for the fibre-sorting or fibre-selection of a fibre bundle comprising textile fibres, the apparatus comprising:

a fibre sorting device comprising a first roller and a second roller that rotate rapidly without interruption during use, wherein the first roller and the second roller rotate in opposite directions;

clamping devices distributed about the periphery of the first roller and the second roller, each clamping device adapted to clamp a bundle of the textile fibres at a clamping site located at a distance from a free end of the fibre bundle;

a supply device adapted to supply the fibre bundle to the fibre-sorting device; and at least one mechanical device adapted to generate a combing action from the clamping site to the free end of the fibre bundle in order to loosen and remove non-clamped constituents; and at least one guide device that influences the transfer of fibre material between said first roller and said second roller.

2. An apparatus according to claim 1, wherein the first roller comprises a turning rotor the second roller comprises a combing rotor.

3. An apparatus according to claim 2, wherein the at least one guide device comprises a pneumatic guide device.

4. An apparatus according to claim 3, wherein the at least one pneumatic guide device includes at least one suction device and/or at least one blowing device.

5. An apparatus according to claim 4, wherein the at least one suction device is an extractor hood and/or the at least one blowing device is a blowing hood.

6. An apparatus according to claim 5, wherein the at least one extractor hood is connected to a source of reduced pressure.

7. An apparatus according to claim 6, wherein the reduced pressure at each extractor hood is adjustable.

8. An apparatus according to claim 5, comprising at least one blowing hood connected to a source of increased pressure.

9. An apparatus according to claim 8, wherein the increased pressure at each blowing hood is adjustable.

10. An apparatus according to claim 5, wherein the at least one hood is arranged in a nip region between the turning rotor and the combing rotor.

11. An apparatus according to claim 10, wherein the at least one hood has a position that is adjustable in relation to the nip region.

12. An apparatus according to claim 10, wherein the at least one hood has an angle that is adjustable.

13. An apparatus according to claim 5, wherein the at least one hood comprises a transverse duct adapted to optimize flow through the hood.

14. An apparatus according to claim 5, comprising at least one extractor hood and at least one blowing hood, wherein the at least one extractor hood has an opening slot of a first size, and the at least one blowing hood has an opening slot of a second size that is different from the first size.

15. An apparatus according to claim 5, comprising at least one extractor hood and at least one blowing hood, wherein the at least one extractor hood has a cross-section of a first size and the at least one blowing hood has a cross-section of a second size that is different from the first size.

16. An apparatus according to claim 4, wherein the at least one pneumatic guide device includes at least one blowing device having a nozzle providing an air jetting which assists pre-alignment of the fibre bundles ahead of transfer.

17. An apparatus according to claim 16, wherein the jetting has a pressure that is adjustable.

18. An apparatus according to claim 16, wherein the jetting is arranged at an angle that is adjustable.

19. An apparatus according to claim 2, wherein the guide device has at least one hood and/or at least one nozzle which is/are associated with the outer periphery of the turning rotor and/or the outer periphery of the combing rotor.

20. An apparatus according to claim 1, further comprising at least one suction device associated with the clamping devices in a region where the fibre material transfers from the first roller to the second roller.

21. An apparatus according to claim 1, wherein the guide device is adapted to optimize feed and/or positioning for the delivery of the fibre material from said first roller to said second roller, and/or to optimize the take-up of fibre material by said second roller from said first roller.

* * * * *